US006810843B2

(12) United States Patent
Quinn, Jr.

(10) Patent No.: US 6,810,843 B2
(45) Date of Patent: Nov. 2, 2004

(54) CONTROL METHOD FOR ACHIEVING EXPECTED VCT ACTUATION RATE USING SET POINT RATE LIMITER

(75) Inventor: Stanley B. Quinn, Jr., Elmhurst, IL (US)

(73) Assignee: BorgWarner Inc., Auburn Hills, MI (US)

( * ) Notice: Subject to any disclaimer, the term of this patent is extended or adjusted under 35 U.S.C. 154(b) by 4 days.

(21) Appl. No.: 10/303,526

(22) Filed: Nov. 25, 2002

(65) Prior Publication Data

US 2003/0230262 A1 Dec. 18, 2003

Related U.S. Application Data

(60) Provisional application No. 60/389,199, filed on Jun. 17, 2002.

(51) Int. Cl.[7] ..... F01L 1/34

(52) U.S. Cl. ..... 123/90.15; 123/90.17; 74/568 R

(58) Field of Search ..... 123/90.12, 90.15, 123/90.16, 90.17, 90.18, 90.31; 74/568 R; 464/1, 2, 160; 361/160, 159, 152, 154, 139

(56) References Cited

U.S. PATENT DOCUMENTS

| | | | | |
|---|---|---|---|---|
| 4,013,965 A | * | 3/1977 | Scharfe, Jr. | 375/334 |
| 4,627,825 A | * | 12/1986 | Bruss et al. | 464/2 |
| 4,756,321 A | * | 7/1988 | Livingston et al. | 134/56 D |
| 5,002,023 A | | 3/1991 | Butterfield et al. | 123/90.15 |
| 5,107,804 A | | 4/1992 | Becker et al. | 123/90.17 |
| 5,172,659 A | | 12/1992 | Butterfield et al. | 123/90.17 |
| 5,184,578 A | | 2/1993 | Quinn, Jr. et al. | 123/90.17 |
| 5,289,805 A | | 3/1994 | Quinn, Jr. et al. | 123/90.17 |
| 5,361,735 A | | 11/1994 | Butterfield et al. | 123/90.17 |
| 5,436,538 A | * | 7/1995 | Garvey et al. | 318/52 |
| 5,460,129 A | * | 10/1995 | Miller et al. | 123/90.15 |
| 5,497,738 A | | 3/1996 | Siemon et al. | 123/90.17 |
| 5,532,926 A | * | 7/1996 | Dunn et al. | 700/73 |
| 6,246,831 B1 | * | 6/2001 | Seitz et al. | 392/486 |
| 6,318,314 B1 | | 11/2001 | Otto et al. | 123/90.15 |
| 2002/0152017 A1 | * | 10/2002 | Russell et al. | 701/110 |

FOREIGN PATENT DOCUMENTS

| | | |
|---|---|---|
| DE | 1087106a | 3/2001 |

* cited by examiner

*Primary Examiner*—Thomas Denion
*Assistant Examiner*—Jaime Corrigan
(74) *Attorney, Agent, or Firm*—Brown & Michaels, PC; Greg Dziegielewski

(57) ABSTRACT

In a VCT system having a feedback loop for controlling a phaser angular relationship, a control law disposed to receive a plurality of set point values and a plurality of feed back values is provided to include: a computation block for receiving the plurality of set point values as inputs, the computation block outputting a first output and a second output; a first summer for summing the first output and the plurality of feed back values to produce a first sum ($e_0$); a phase integrator and a phase compensator receiving the first sum ($e_0$) and derivatives ($e_1$) thereof outputting a processed value ($e_2$); a amplifier amplifying the second output by a predetermined scale ($K_{ff}$); and e) a second summer for summing the processed value ($e_2$) and the amplified second output to produce a second sum ($e_3$).

11 Claims, 5 Drawing Sheets

CONTROL METHOD FOR ACHIEVING EXPECTED VCT ACTUATION RATE USING SET POINT RATE LIMITER

REFERENCE TO RELATED APPLICATIONS

This application claims an invention which was disclosed in Provisional Application No. 60/389,199, filed Jun. 17, 2002, entitled "Control Method for Achieving Expected VCT Actuation Rate Using Set Point Rate Limiter". The benefit under 35 USC §119(e) of the United States provisional application is hereby claimed, and the aforementioned application is hereby incorporated herein by reference.

BACKGROUND OF THE INVENTION

1. Field of the Invention

The invention pertains to the field of variable camshaft timing (VCT) systems. More particularly, the invention pertains to a control method for achieving expected VCT actuation rate using set point rate limiter to impede the impact of sudden changes upon the VCT system.

2. Description of Related Art

Consideration of information disclosed by the following U.S. patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control algorithm that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotates with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

Referring to FIG. 1, a prior art closed loop feedback system 10 is shown. The control objective of feedback loop 10 is to have a spool valve in a null position. In other words, the objective is to have no fluid flowing between two fluid holding chambers of a phaser (not shown) such that the VCT mechanism at the phase angle given by a set point 12 with the spool 14 stationary in its null position. This way, the VCT mechanism is at the correct phase position and the phase rate of change is zero. A control computer program product which utilizes the dynamic state of the VCT mechanism is used to accomplish the above state.

The VCT closed-loop control mechanism is achieved by measuring a camshaft phase shift $\theta_0$ 16, and comparing the same to the desired set point r 12. The VCT mechanism is in turn adjusted so that the phaser achieves a position which is determined by the set point r 12. A control law 18 compares the set point 12 to the phase shift $\theta_0$ 16. The compared result is used as a reference to issue commands to a solenoid 20 to position the spool 14. This positioning of spool 14 occurs when the phase error (the difference between set point r 12 and phase shift 20) is non-zero.

The spool 14 is moved toward a first direction (e.g. right) if the phase error is positive (retard) and to a second direction (e.g. left) if the phase error is negative (advance). When the phase error is zero, the VCT phase equals the set point r 12 so the spool 14 is held in the null position such that no fluid flows within the spool valve. Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase difference is defined as the time from successive crank-to-cam pulses, divided by the time for an entire revolution and multiplied by 360.degree. The measured phase difference may be expressed as $\theta_0$ 16. This phase difference is then supplied to the control law 18 for reaching the desired spool position.

The rate of change for the set point 12 can cause overshoot if rate exceeds a limit inherent to the VCT system. Since a controller such as an engine control unit (ECU) needs to control the rate limit, it is desirous to have a method such as a method capable of incorporating into a computer program product to know when or in what region of the set point change the system is currently operating. Once the overshoot region is identified, proper filtering can be applied thereto.

SUMMARY OF THE INVENTION

A method for a VCT system that limits the time rate of change of the set point is provided.

A method for a VCT system for avoiding overshoot in the system response is provided. The method involves providing a filter whenever a condition is detected that would otherwise lead to overshoot. Filtering the set point cancels the control loop zero dynamics that cause the overshoot.

A method for a VCT system utilizing feed forward (of set point slope information) in the feedback control loop is provided. The instantaneous slope of the modified set point rate of change is made available to the control law, thereby causing immediate changes in spool position. Thus, changes in VCT phase rate occurs, thereby reducing loop error.

Accordingly, in a VCT system having a feedback loop for controlling a phaser angular relationship, a control law disposed to receive a plurality of set point values and a plurality of feed back values is provided to include: a computation block for receiving the plurality of set point values as inputs, the computation block outputting a first output and a second output; a first summer for summing the first output and the plurality of feed back values to produce a first sum; a phase integrator and a phase compensator receiving the first sum and derivatives thereof outputting a processed value; a amplifier amplifying the second output by a predetermined scale; and e) a second summer for summing the processed value and the amplified second output to produce a second sum.

Accordingly a VCT system is provided to include: sensors for receiving position information of cam and crank shafts respectively; a phaser for adjusting small changes between the crank and cam shafts; an actuator engaging the phaser. The VCT system also includes a controller for controlling the actuator, the controller including a control law, wherein the control law includes: a computation block for receiving the plurality of set point values as inputs, the computation block outputting a first output and a second output; a first summer for summing the first output and the plurality of feed back values to produce a first sum; a phase integrator and a phase compensator receiving the first sum and derivatives thereof outputting a processed value; a amplifier amplifying the second output by a predetermined scale; and a second summer for summing the processed value and the amplified second output to produce a second sum.

Accordingly, in a VCT system having a feedback loop for controlling a phaser relationship with the system having a controller is provided. The controller includes a control law disposed to receive a plurality of set point values and a plurality of feed back values. The control law is disposed to perform a method comprising the steps of: providing a set point change; determining a mode of the VCT system among a set of four modes; and selectively applying a filter upon the set point change. Thereby overshoot caused by set point change is reduced.

DETAILED DESCRIPTION OF THE INVENTION

Change of VCT set point is limited by a rate limit wherein if the rate of set point change exceeds the limit, undesirable things such as unacceptable overshoot occur. The VCT, which may respond somewhat faster, is throttled to consistently change in a predictable manner. A filter can be applied to a set of regions (which is described in detail infra) of set points to reduce overshoot. In other words, whenever a condition is detected that would otherwise lead to overshoot in the system response, a filter is applied. Filtering the set point cancels the control loop dynamics that cause the overshoot. Further, feedforward approach is utilized in the control loop as well.

The present invention teaches that the instantaneous slope of the modified set point is made available to the control law. This causes immediate changes in spool position; hence loop error can be reduced using VCT phase rate.

The sudden changes of raw set point 12 causing unacceptable overshoot can be reduced by the present invention. The present invention limits the time rate of change of the set point via a predetermined rate limit. By establishing this rate limit, the VCT, which may respond somewhat faster, is throttled to consistently change in a predictable manner. VCT stands for Variable Cam Timing which is a process, not a thing. VCT refers to controlling or varying the angular relationship (phase) between one or more camshafts, which drive the engine's intake and/or exhaust valves, and the crankshaft which is connected to the pistons. The varying of the angular relationship is typically accomplished by means using a phaser.

The present invention further avoids overshoot in the system response. A filter is applied whenever a condition is detected that would otherwise lead to overshoot. By filtering the set point, the cause of the overshoot is canceled. Furthermore, by using a feed forward approach within the control law, the instantaneous slope of the modified set point is made available to the control law for improved processing. Thereby causes immediate changes in spool position, hence changes VCT phase rate, to the desired instantaneous slope.

The present invention subdivides set point change process into four modes for real time processing. Real-time execution is in two stages. First, the appropriate mode is determined according to the current input signals and previous operating conditions. Then, the computations for the appropriate mode are performed. The resultant modified set point provides an input to the current closed-loop such as the input to solenoid 20. The input is a modification, however slight, of the existing prior art control law such as control law 18.

Figure 2:
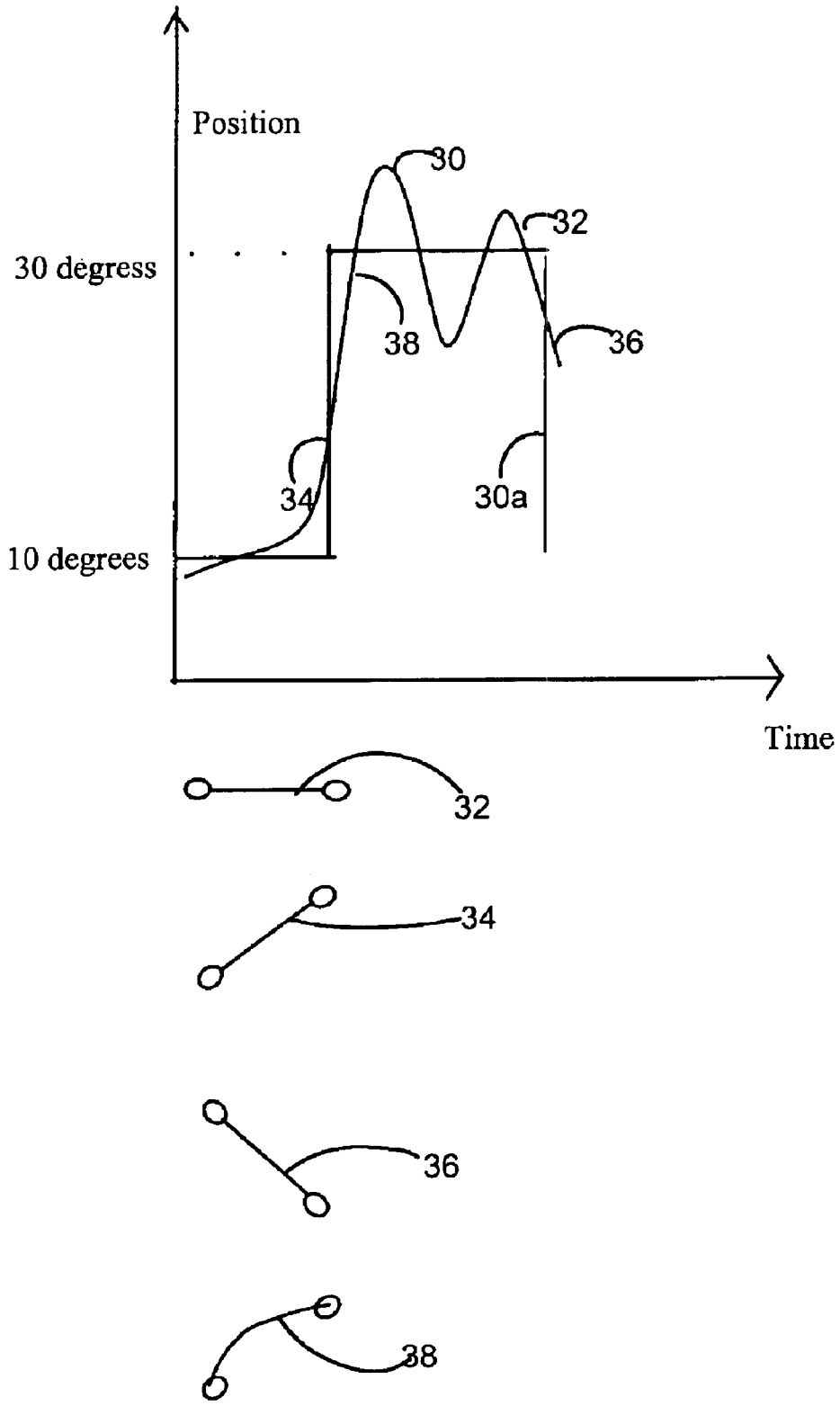
FIG. 2 shows a graph depicting the present invention.

FIG. 2 illustrate the instant method, y-co-ordinate is a set of setpoints for phaser position (Only two degrees, i.e. 10 and 30 degrees are shown). The x-co-ordinate stands for time. Graph 30 depicts a change of set point values in a VCT application. For example, controller may command spool valve 14 to move a phaser from 10 to 30 degrees, as shown in the first step change in square wave 30. In the idealized situation, where the system possesses no inertia, system response may follow exactly the path of square wave 30*a*. However, in reality, the system response may look like wave 30. As can be seen, graph 30 possesses an overshoot. Graph 30 is further subdivided into 4 sections denoted as 4 modes for digitized determination purposes. It is pointed out herein that a controller, such as an engine control unit (ECU), processes only discrete points of graph 30. The 4 modes are used to indicate to the control digitally what mode or condition the system possesses at a certain time. The modes are denoted by numerals 32, 34, 36, and 38 respectively. Mode 32 denotes the condition wherein there is no substantial change in set point values; mode 34 denotes the condition wherein there is a substantial increase in set point values; mode 36 denotes the condition wherein there is a substantial decrease in set point values; and mode 38 denotes the condition wherein the measured phaser is close to or in the neighborhood of the set point and the set point filter is invoked. The 4 modes are depicted both separately and incorporated in graph 30. This overshoot is undesirable, and the controller needs to control or reduce substantially the overshoot. A necessary condition is for the controller to know when mode 38 occurs before reduction of over-shoot can be performed.

It is pointed out that the controller performs real-time execution in two stages. First, the appropriate mode is determined according to the current input signals and previous operating conditions. Then, the computations for the appropriate mode are performed. The resultant modified set point provides the input to the control law. A modification to control law 18 is made to use the slope information or the rate of change of set point at this juncture. It is noted that the modification may be a very slight modification of the control law 18.

The following is an exemplified embodiment of the present invention suitable for being used by a controller. The embodiments of the input signals and previous operating conditions are illustrated below. A set of parameters is listed below for use by the controller. Input may be the raw set point input denoted in degrees. A first output (also in degrees) may be a modified set point based upon the input. A second output may be a rate of change in time of the modified set point denoted in degrees per second. Some of the embodiments are formalistically listed below.

Input uraw=raw set point input, in degrees

Outputs umod=modified set point, in degrees slope=time rate of change of modified set point, deg/sec The parameters include "mup", which denotes the maximum increase in slew rate. "mdown" is the maximum decreasing slew rate (a positive value) denoted in degrees per second (deg/sec). Both "mup" and "mdown" is specified based on VCT system specification. "wset" is the filter corner frequency denoted in radius per second (rad/sec). In this exemplified embodiment, mup/wset and mdown/wset are preferably precomputed constants as shown below. "Epsilon" is the threshold for steady-state transition denoted in degrees. The threshold value can be determined based on need. "Ts" is the sample time in seconds. "Kff" is the feed-forward gain, which is denoted in per centage in degree seconds %/(deg/sec). The following are the formalistic listings of the parameters.

Parameters mup=maximum increasing slew rate, deg/sec mdown=maximum decreasing slew rate (a positive value), deg/sec wset=filter corner frequency, rad/sec (as seen below, mup/wset and mdown/wset are preferably precomputed constants)

epsilon=threshold for steady-state transition, in degrees

Ts=sample time, sec alpha=exp(−wset*Ts)

Kff=feedforward gain, %/(deg/sec)

Variables include static variables and temporary variables. Static variables include "olduraw" which is the "uraw" from previous iteration such as the iteration immediate before the current iteration. Static variables further include "oldumod", which is the "umod" from previous iteration, such as the iteration immediately before. Temporary variables include uchange which is the requested change in uraw from umod. Temporary variables further include "deltaraw" which is the change in uraw from previous iteration. The following are the formalistic listings of the variables.

Static Variables olduraw=uraw from previous iteration oldumod=umod from previous iteration Temporary Variables uchange=requested change in uraw from umod deltaraw=change in uraw from previous iteration As can be appreciated, the 4 modes include the following states or conditions. First, system is in a steady-state whereby the modified set point is simply the raw set point. Second, the system is in a ramp up mode whereby the modified set point increases at the maximum positive slew rate. Third, the system is in a ramp down mode whereby the modified set point decreases at the maximum negative slew rate. And fourth, the system is at a filtering mode whereby the raw set point is passed through a first-order low-pass filter to produce the modified set point. At this juncture, the filter is automatically initialized correctly when this mode is entered. The following are the formalistic listings of the modes.

Modes steady-state—the modified set point is simply the raw set point ramp up—the modified set point increases at the maximum positive slew rate ramp down—the modified set point decreases at the maximum negative slew rate filter—the raw set point is passed through a first-order low-pass filter to produce the modified set point. The filter is automatically initialized correctly when this mode is entered.

The followings are the logic for determining the various states which can be incorporated into a computer product subroutine. For example, a vehicle engine control unit (ECU) can have the logic incorporated therein. Initially, define "uchange" as "uraw" minus "oldumod", i.e. the umod from previous iteration. And uraw is the raw set point input in degrees. Furthermore, define "deltaraw" as "uraw" minus "olduraw". Then if the absolute value of uchange is less than a predetermined value (i.e., epsilon), then the system mode is determined to be in the steady state. Otherwise, if the following condition is met, else if ((uchange>=mup/wset)|((uchange>=epsilon)&(steady-state|ramp down)))

then, the system is in ramp up mode. If the following condition is met, else if ((uchange<=−mdown/wset)|((uchange<−epsilon) & (steady-state|ramp up)))

then, the system is in ramp down mode. If the following condition is met, else if (((ramp up)&(0<=uchange<mup/wset)&(deltaraw<=epsilon))|((ramp down)&(−mdown/wset<uchange<0)&(deltaraw>=−epsilon)))

then, the system is in the filter mode. If none of the above conditions are met, then it means there is no change in mode. The following are the formalistic listings of the static logic.

State Logic

```
uchange=uraw−oldumod
deltaraw=uraw−olduraw
if abs(uchange)<epsilon
    mode=steady-state
else if ((uchange>=mup/wset)|((uchange>=epsilon)&
    (steady-state|ramp down)))
    mode=ramp up
else if ((uchange<=−mdown/wset)|((uchange<=−epsilon)
    &(steady-state|ramp up)))
    mode=ramp down
else if (((ramp up)&(0<=uchange<mup/wset)&
    (deltaraw<=epsilon))|((ramp down)&(−mdown/
    wset<uchange<0)&(deltaraw>=−epsilon)))
    mode=filter
/*else mode=mode, no change*/
```

With regard to set point computation, the mode of the system is determined the following ways. If the system is at the steady-state, then "uraw" is set as the system mode. Otherwise, if the system is at ramp up mode, the system mode is expressed as the following:

umod=oldumod+mup*Ts

If the system is at the ramp down mode, the system mode is expressed as shown below:

umod=oldumod−mup*Ts

If none of the above conditions are met, the system is considered to be in a filtermode, wherein umod is expressed as follows alpha=exp(−wset*Ts),

```
umod=(1−alpha)*uraw+alpha*oldumod
if (oldumod>=uraw)
umod=max(umod, uraw)
else
umod=min(umod, uraw)
slope=(umod−oldumod)/Ts
oldumod=umod
olduraw=uraw
```

The following are the formalistic listings of the set point computation.

Set Point Computation

```
if steady-state
    umod=uraw
else if ramp up
    umod=oldumod+mup*Ts
else if ramp down
    umod=oldumod−mup*Ts
else/*filter*/
    umod=(1−alpha)*uraw+alpha*oldumod
if (oldumod>=uraw)
    umod=max(umod, uraw)
else
    umod=min(umod, uraw)
slope=(umod−oldumod)/Ts
oldumod=umod
olduraw=uraw
```

With regard to control law, a high-level description is given below in formative expressions without scaling the data or coefficients. The details of a computer program product incorporating a method of the system remain unchanged except for the addition of the feedforward signal (Kff*slope) in e3. The system's e0 is still umod minus theta, wherein theta denotes the VCT phase; e1 is still expressed as equal to: Kp*e0+Ki*x wherein in PI control block, x=integrator state; and e2 is the compensated e1, or the phase lead compensation. However, e3 is expressed as: dcnull−e2+Kff*slope where the sign of e2 depends on VCT system hydraulic porting. The control parameter is further limited by the following expression:

control=max(min(*e*3, *dc*max), *dc*min)+dither/*limit and add dither*/

The following are the formalistic listings of the control law.

Control Law

/*A high-level description is given below, without scaling the data or coefficients. The details of the algorithm remain unchanged except for the addition of the feedforward signal (Kff*slope) in e3.

```
                                                    */
e0 = umod − theta                   /* theta = VCT phase */
e1 = Kp*e0 + Ki*x                   /* P1 control, x = integrator state */
e2 = compensate(e1)                 /* phase lead compensation */
e3 = dcnull − e2 + Kff*slope        /* sign of e2 depends on intake
                                       or exhaust cam */
control = max(min(e3, dcmax), dcmin) + dither /* limit and add dither */
```

Figure 1:
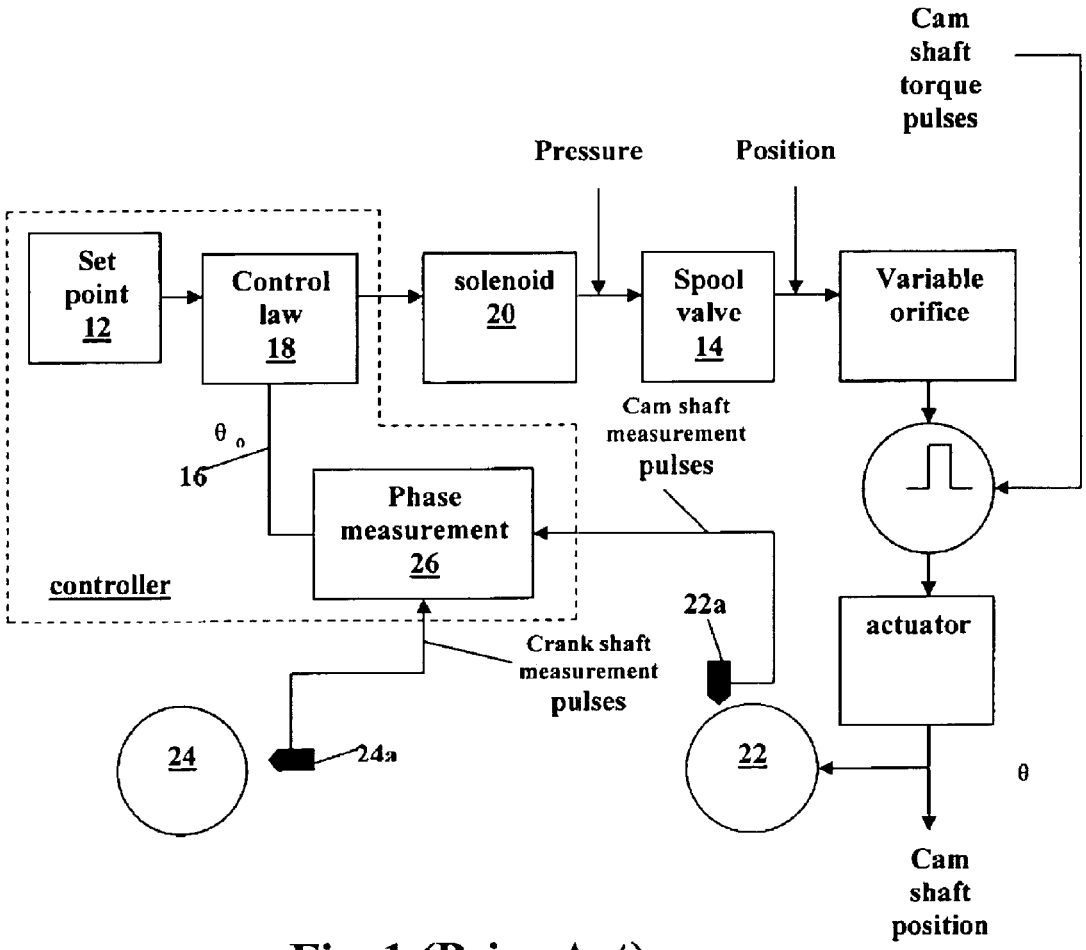
Fig. 1 (Prior Art)
FIG. 1 shows a prior art control loop.
Figure 3:
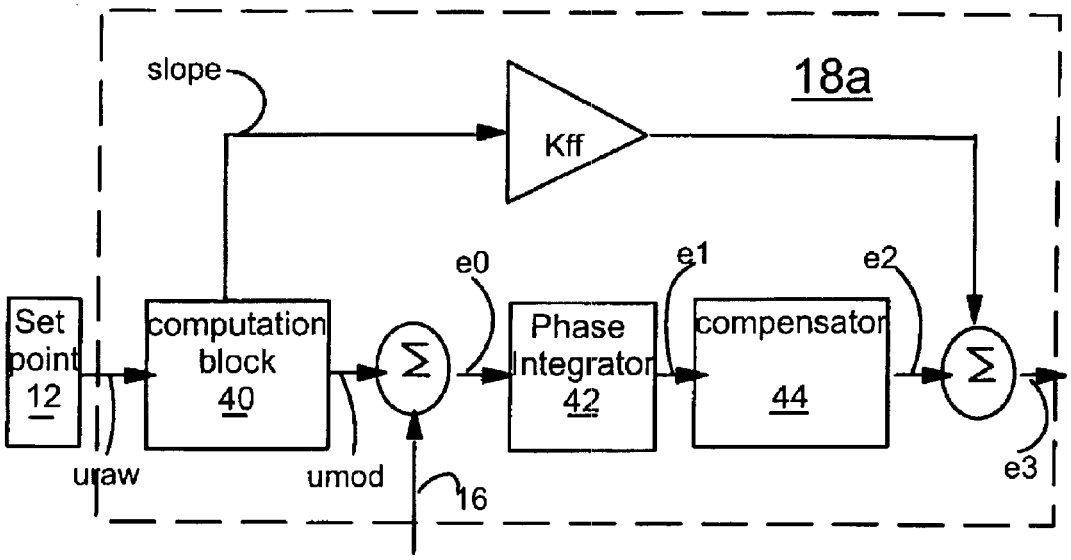
FIG. 3 shows the improved control law of the instant invention wherein slope information is fed forward and amplified.

FIG. 3 shows an improved control law 18*a* of the present invention over prior art such as control law 18 of FIG. 1. As shown in FIG. 3, set point 12 and camshaft phase shift $\theta_0$ 16 is applied to control law 18*a* similar to prior art such as being shown in FIG. 1. A computation block 40 performs substantially the functions or steps listed supra. The input to computation block 40 is "uraw", the outputs are respectively "umod" and slope information. The umod is summed with camshaft phase shift $\theta_0$ 16, the sum is expressed in $e_0$. Sum $e_0$ is, in turn, subjected to a phase integrator 42 to form $e_1$. A phase compensator 44 receives $e_1$, processes the same, and outputs $e_2$. The other output of computation block 40 is the slope information, which is subjected to amplifier $K_{ff}$ and summed with $e_2$. The resultant sum is denoted by $e_3$, which is used by the controller as a value or parameter to control a physical thing such as solenoid 20 of FIG. 1.

Figure 4:
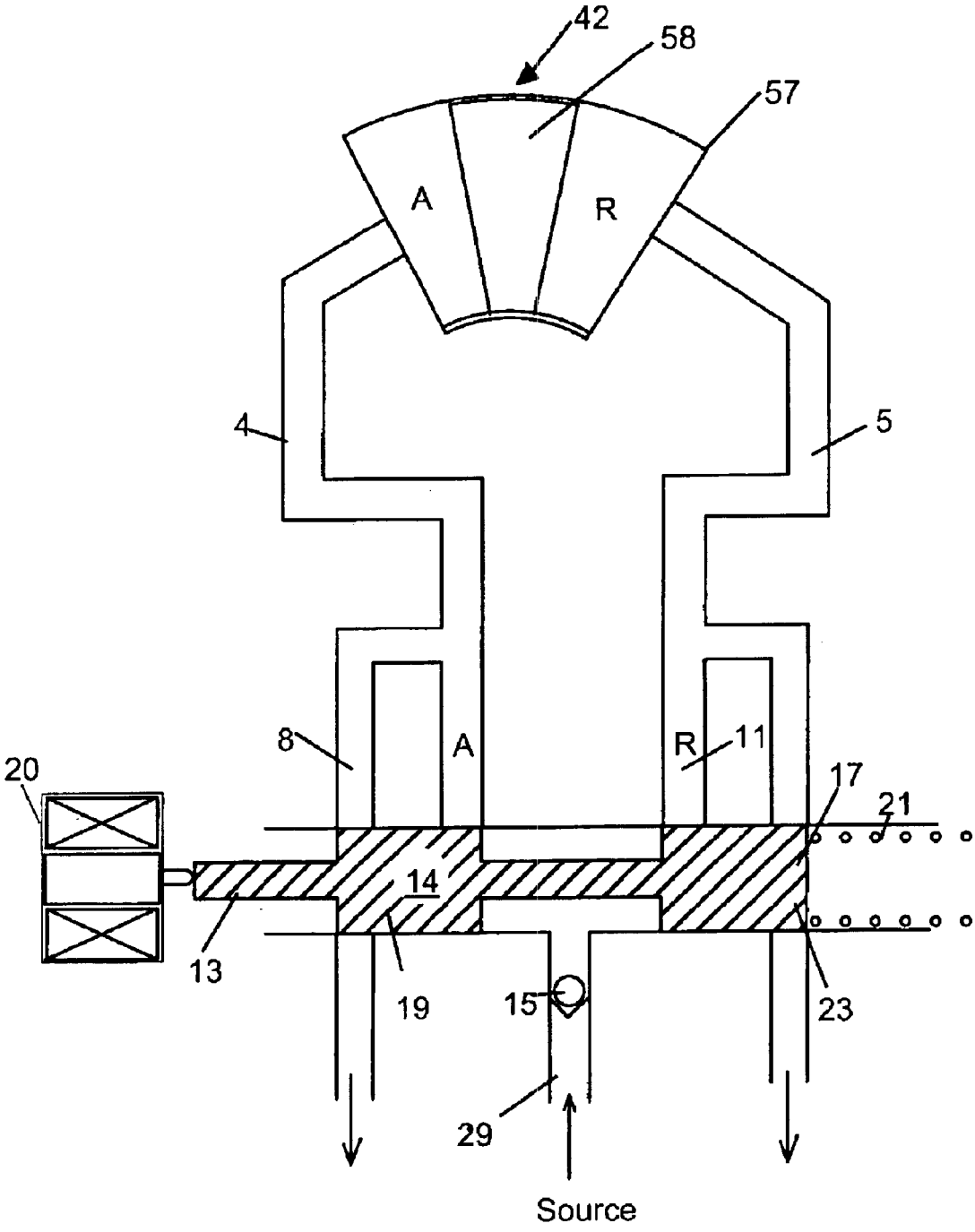
FIG. 4 shows a schematic depiction of VCT system including a phaser suitable for the instant invention.

FIG. 4 is a schematic depiction that shows, in part, the physical relationship of the previous Figs. A null position is shown in FIG. 4. Solenoid 20 engages spool valve 14 by exerting a first force upon the same on a first end 13. The first force is met by a force of equal strength exerted by spring 21 upon a second end 17 of spool valve 14 thereby maintaining the null position. The spool valve 14 includes a first block 19 and a second block 23 each of which blocks fluid flow respectively.

The phaser 42 includes a vane 58, a housing 57 encompassing a chamber using the vane 58 to delimit an advance chamber A and a retard chamber R therein. The chamber is the space within which vane 58 rotates. As the vane rotates within the chamber, the angular position of the camshaft with respect to the crankshaft changes. That is, as the vane advances, the engine valves open sooner relative to engine cycle. In other words, as oil is transferred between chambers A and R, the vane rotates within the overall chamber and the anaular position of the camshaft with respect to the crankshaft changes. That is, as the vane advances, the engine valves open sooner relative to engine cycle.

Typically, the housing and the vane 58 are coupled to crank shaft (not shown) and cam shaft (also not shown) respectively. Vane 58 is permitted to move relative to the phaser housing by adjusting the fluid quantity of advance and retard chambers A and R. If it is desirous to move vane 58 toward the retard side, solenoid 20 pushes spool valve 14 further right from the original null position such that liquid in chamber A drains out along duct 4 through duct 8. The fluid further flows or is in fluid communication with an outside sink (not shown) by means of having block 19 sliding further right to allow said fluid communication to occur. Simultaneously, fluid from a source passes through duct 29 and is in one-way fluid communication with duct 11 by means of one-way valve 15, thereby supplying fluid to chamber R via duct 5. This can occur because block 23 moved further right causing the above one-way fluid communication to occur. When the desired vane position is reached, the spool valve is commanded to move back left to its null position, thereby maintaining a new phase relationship of the crank and cam shaft. The fluid can be any type of actuating fluid which moves the vanes in a vane phaser. The actuating fluid is typically engine oil, but could be other types of separate hydraulic fluid. An one way valve is also known as a check valve which permits fluid flow in only one direction.

A vane is defined as a radial element housed in a chamber on which actuating fluid acts upon. A vane phaser is a phaser which is actuated by vanes moving in chambers. Further the control valve is of spool type (typically the spool rides in bore, connects one passage to another). In addition, the spool valve is most often located on center axis of a rotor which is an inner part of a phaser. The rotor is typically attached to cam shaft.

As can be appreciated, the instant invention improves the accuracy of the VCT system. The invention further reduces the overshoot for an improved real time closed loop control of physical things such as solenoid 20. Solenoid is typically a variable force solenoid (VFS) whose actuating force can be varied, usually by PWM of supply current. VFS is opposed to an on/off (all or nothing) solenoid.

Figure 5:
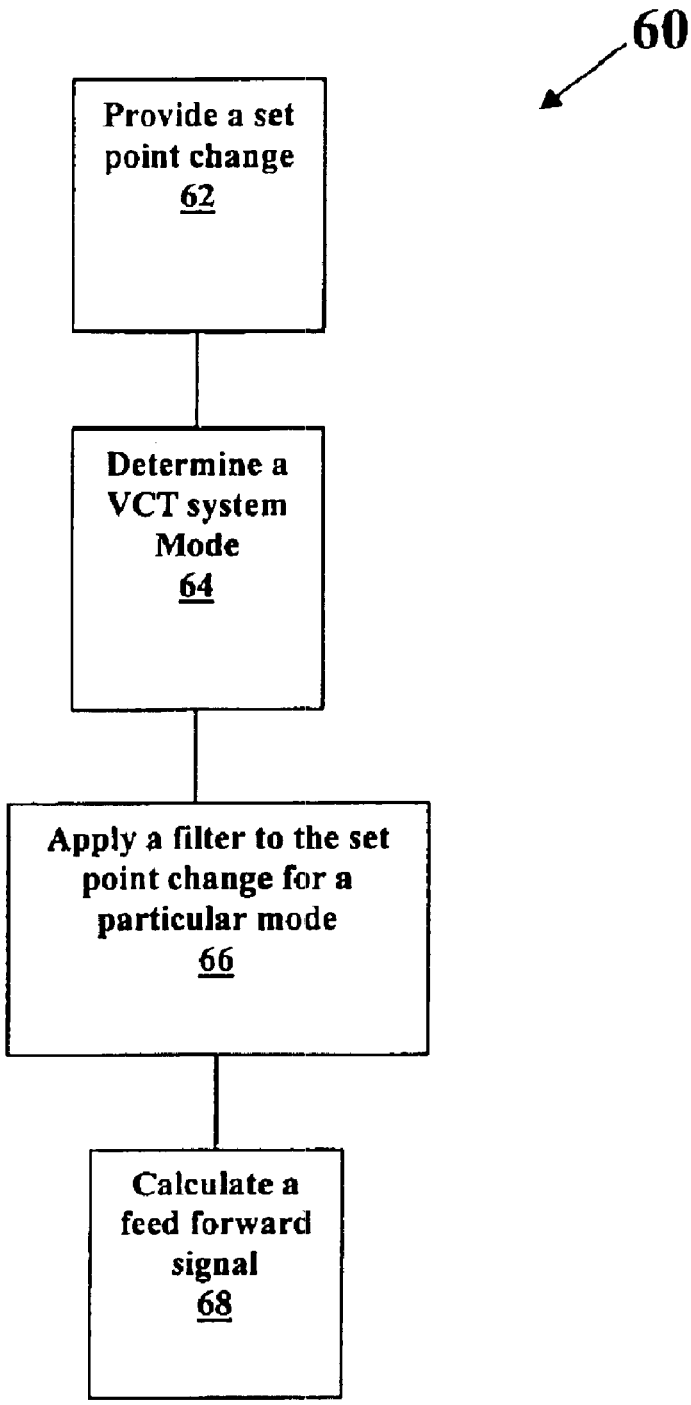
FIG. 5 shows a flowchart depiction one aspect of the present invention.

Referring to FIG. 5, a flowchart 60 depicting the present invention is shown. Flowchart 60 is applicable in a VCT system that has a feedback loop for controlling a phaser or angular relationship. The system including a controller such as the ECU that includes a control law which disposed to receive a plurality of set point values and a plurality of feed back values. The control law is disposed to perform a method which includes the steps of the provisioning of a set point change (step 62); determining a mode of said VCT system among a set of four modes (step 64); and selectively applying a filter upon said set point change (step 66). Thereby, overshoot caused by set point change is reduced. The method further includes calculating feedforward signal (step 68).

One embodiment of the invention is implemented as a program product for use with a computer system such as, for example, the schematics shown in FIGS. 3, 5 and described below. The program(s) of the program product defines functions of the embodiments (including the methods described below with reference to the formalistic depictions supra and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); (iv) information conveyed to a computer by a communications medium, such as through a computer or telephone network, including wireless communications, or a vehicle controller of an automobile. Some embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

VCT system typically includes a phaser, control valve(s), control valve actuator(s) and control circuitry. A set point is one of a set of values determined by a controller such as an ECU.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA)VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Camber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is most often located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. In a Variable Cam Timing system having a feedback loop for controlling a phaser relationship, said system including a controller having a control law disposed to receive a plurality of set point values and a plurality of feed back values, said control law being disposed to perform a method comprising the steps of:

a) providing a set point change;

b) determining a mode of said VCT system among a set of four modes; and c) selectively applying a filter upon said set point change, thereby reducing overshoot caused by set point change.

2. The method of claim 1 further comprising calculating feedforward signal.

3. The method of claim 1, wherein said set of four modes includes:

a first mode wherein there is no substantial change in set point values;

a second mode wherein there is a substantial increase in set point values;

a third mode wherein there is a substantial decrease in set point values; and a fourth mode wherein the measured position of phaser is close to the set point.

4. The method of claim 3, wherein said filter is applied when said Variable Cam Timing system is under said fourth mode.

5. In a Variable Cam Timing system having a feedback loop for controlling a phaser angular relationship, said system including a controller having a control law disposed to receive a plurality of set point values and a plurality of feed back values, said control law comprising:

a) a computation block for receiving said plurality of set point values as inputs, said computation block outputting a first output and a second output;

b) a first summer for summing said first output and said plurality of feed back values to produce a first sum;

c) a phase integrator and a phase compensator receiving said first sum and derivatives thereof outputting a processed value;

d) a amplifier amplifying said second output by a predetermined scale; and e) a second summer for summing said processed value and the amplified second output to produce a second sum.

6. The control law of claim 5, wherein said first output includes mode information.

7. The control law of claim 5, wherein said second output includes slope information of said plurality of set point values.

8. A Variable Cam Timing system, comprising:

sensors for receiving position information of cam and crank shafts respectively;

a phaser for adjusting small changes between said crank and cam shafts;

an actuator engaging said phaser;

a controller for controlling said actuator, said controller including a control law, wherein said control law includes:

a computation block for receiving said plurality of set point values as inputs, said computation block outputting a first output and a second output;

a first summer for summing said first output and said plurality of feed back values to produce a first sum;

a phase integrator and a phase compensator receiving said first sum and derivatives thereof outputting a processed value;

a amplifier amplifying said second output by a predetermined scale; and a second summer for summing said processed value and the amplified second output to produce a second sum.

9. The Variable Cam Timing system of claim 8, wherein said first output includes mode information.

10. The Variable Cam Timing system of claim 8, wherein said second output includes slope information of said plurality of set point values.

11. The Variable Cam Timing system of claim 8, wherein said actuator is a solenoid.

* * * * *